US010974797B1

(12) United States Patent
Wurts

(10) Patent No.: US 10,974,797 B1
(45) Date of Patent: Apr. 13, 2021

(54) SURF CRAFT HAVING AN IMPROVED CHANNEL

(71) Applicant: William Aldis Wurts, Princeton, KY (US)

(72) Inventor: William Aldis Wurts, Princeton, KY (US)

( * ) Notice: Subject to any disclaimer, the term of this patent is extended or adjusted under 35 U.S.C. 154(b) by 0 days.

(21) Appl. No.: 17/069,657

(22) Filed: Oct. 13, 2020

Related U.S. Application Data

(60) Provisional application No. 62/914,709, filed on Oct. 14, 2019.

(51) Int. Cl.

| | |
|---|---|
| ***B63B 35/00*** | (2020.01) |
| ***A63C 5/03*** | (2006.01) |
| ***B63B 32/22*** | (2020.01) |
| ***B63B 32/50*** | (2020.01) |

(52) U.S. Cl.
CPC ..... *B63B 32/22* (2020.02); *B63B 32/50* (2020.02); *B63B 2241/04* (2013.01)

(58) Field of Classification Search
CPC ..... B63B 32/00; B63B 32/22; B63B 32/50; B63B 32/53; B63B 32/56; B63B 2241/00; B63B 2241/02; B63B 2241/04; B63B 2241/20; B63B 32/20
USPC ..... 441/65, 74, 79
See application file for complete search history.

(56) References Cited

U.S. PATENT DOCUMENTS

| | | | | |
|---|---|---|---|---|
| 6,203,389 | B1 * | 3/2001 | Pearson | B63B 32/00 441/65 |
| 7,074,098 | B1 * | 7/2006 | Acosta, Jr. | B63B 32/50 441/65 |
| 9,440,715 | B2 * | 9/2016 | Rizzo | B63B 32/45 |

* cited by examiner

*Primary Examiner* — Daniel V Venne
(74) *Attorney, Agent, or Firm* — Robinson IP Law, PLLC

(57) ABSTRACT

A surf craft includes: a body having a nose and a tail; a bottom surface extending from the nose of the body to the tail of the body; a channel formed in the bottom surface of the body, the channel including a channel entrance located towards the nose of the body having a depth that is substantially flush with the bottom surface of the surf craft, a channel exit having a depth such that a bottom surface of the channel curves from the bottom surface of the surf craft towards an upper surface of the surf craft, first and second opposing sidewalls. The first and second opposing sidewalls curve outwards along a substantial portion of the channel such that a width of the channel exit is wider than a width of the channel entrance.

14 Claims, 13 Drawing Sheets

SURF CRAFT HAVING AN IMPROVED CHANNEL

CROSS-REFERENCE TO RELATED APPLICATION

This application claims priority to and is a non-provisional of U.S. Patent Application Ser. No. 62/914,709 for a "Surf Craft Having an Improved Channel" filed on Oct. 14, 2019, which is incorporated herein by reference in its entirety.

FIELD

This disclosure relates to the field of surf craft. More particularly, this disclosure relates to surf craft having one or more channels formed on a bottom thereof.

BACKGROUND

Surf craft, such as bodyboards, kneeboards, surfboards, sailboards, wake surf boards, wakeboards, and paddle boards, may include one or more devices to aid in tracking or directional control of the surf craft. For example, surf craft frequently include fins located on a bottom of the surf craft to aid in directional control of the surf craft as the surf craft moves through water. Bodyboards are typically finless and rarely have fins attached.

Further, surf craft may also employ specific shaping along a bottom surface of the surf craft to further aid in controlling the surf craft. Exemplary shaping may include a shallow concave depression on the bottom of the surf craft to improve performance. Benefits may include better lift, speed, and traction of the surf craft.

Providing a concave bottom of the surf craft aids in compressing the flow of water along the bottom surface of the surf craft down a length of the surf craft. Existing shapes begin at or before the widest point where water is urged into a narrower portion of the channel, such as at a tail of the surf craft, thereby increasing pressure of the water and lift on the surf craft. Common designs include single, double and single-to-double concaves. An unusual concave design known as a Venturi concave bottom resembles an hourglass in shape.

Another bottom contour is a channel bottom including a series of straight, flat planes/grooves (typically 4-8) that direct water flow down the length of each groove/channel. These channels are reported to improve hold for turns without creating stiff tracking, which is reported for concave shapes, which can be less responsive as a result.

While attempts have been made to utilize a Venturi concave bottom and other various designs, improvement is needed such that tracking and performance of the surf craft is improved with or without the addition of fins or other various devices on the bottom of the surf craft.

What is needed, therefore, is an improved surf craft having a channel formed along the bottom of the surf craft to enhance performance of the surf craft, such as by improving tracking and handling of the surf craft.

SUMMARY

The above and other needs are met by a surf craft having one or more channels formed on a bottom thereof. In a first aspect, a surf craft includes: a body having a nose at a first end of the body and a tail at a second end of the body; a substantially smooth bottom surface extending from the nose of the body to the tail of the body; a channel formed in the bottom surface of the body, the channel including a channel entrance located towards the nose of the body of the surf craft, the channel entrance having a depth that is substantially flush with the bottom surface of the surf craft, a channel exit located towards the tail of the body, the channel exit having a depth such that a bottom surface of the channel curves from the bottom surface of the surf craft towards an upper surface of the surf craft, first and second opposing sidewalls, with a substantial portion of each of the first and second opposing sidewalls oriented substantially perpendicular to the bottom surface within the channel of the surf craft. The first and second opposing sidewalls are substantially parallel to each other at the channel entrance and the first and second opposing sidewalls curve outwards towards the channel exit such that a width of the channel exit is wider than a width of the channel entrance.

In one embodiment, the first and second opposing sidewalls are parallel to one another from the channel entrance to a distance that is from about 20% to about 80% of a length of the channel. In another embodiment, the first and second opposing sidewalls are parallel from the channel entrance to a distance that is from about 40% to about 60% of a length of the channel.

In yet another embodiment, the surf craft is a surfboard. In one embodiment, the surf craft is a body board.

In another embodiment, the surf craft further includes a second channel formed in the bottom surface of the body, the second channel oriented parallel to the first channel. In yet another embodiment, the channel is formed in a cartridge that is installed on the surf craft.

In yet another embodiment, the first and second opposing sidewalls are shaped as asymptotic curves.

In one embodiment, the channel has a depth of from about 0 inches to about 0.1 inches at the entrance of the channel and a depth of from about 0.2 inches to about 4 inches at the channel exit.

In a second aspect, a surfboard includes: a body having a nose at a first end of the body and a tail at a second end of the body; a substantially smooth bottom surface extending from the nose of the body to the tail of the body; a channel formed in the bottom surface of the body, the channel including a channel entrance located towards the nose of the body of the surf craft, the channel entrance having a depth that is substantially flush with the bottom surface of the surf craft, a channel exit located towards the tail of the body, the channel exit having a depth such that a bottom surface of the channel curves from the bottom surface of the surf craft towards an upper surface of the surf craft, first and second opposing sidewalls, with a substantial portion of each of the first and second opposing sidewalls oriented substantially perpendicular to the bottom surface within the channel of the surf craft. The first and second opposing sidewalls are substantially parallel to each other at the channel entrance and the first and second opposing sidewalls curve outwards towards the channel exit such that a width of the channel exit is wider than a width of the channel entrance.

In a third aspect, a bodyboard includes: a body having a nose at a first end of the body and a tail at a second end of the body; a substantially smooth bottom surface extending from the nose of the body to the tail of the body; a channel formed in the bottom surface of the body, the channel including a channel entrance located towards the nose of the body of the surf craft, the channel entrance having a depth that is substantially flush with the bottom surface of the surf craft, a channel exit located towards the tail of the body, the channel exit having a depth such that a bottom surface of the channel curves from the bottom surface of the surf craft towards an upper surface of the surf craft, first and second opposing sidewalls, with a substantial portion of each of the first and second opposing sidewalls oriented substantially perpendicular to the bottom surface within the channel of the surf craft. The first and second opposing sidewalls are substantially parallel to each other at the channel entrance and the first and second opposing sidewalls curve outwards towards the channel exit such that a width of the channel exit is wider than a width of the channel entrance.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings. Some of these terms are defined below for the purpose of clarity. The definitions given below are meant to cover all forms of the words being defined (e.g., singular, plural, present tense, past tense). If the definition of any term below diverges from the commonly understood and/or dictionary definition of such term, the definitions below control.

Embodiments described herein include a surf craft having a shape such that a Coanda Effect is induced along a bottom surface of the surf craft to improve handling of the surf craft. The surf craft described herein advantageously provides an enhanced bottom surface to augment handling of the surf craft relative to existing designs to improve performance characteristics of the surf craft.

Figure 1:
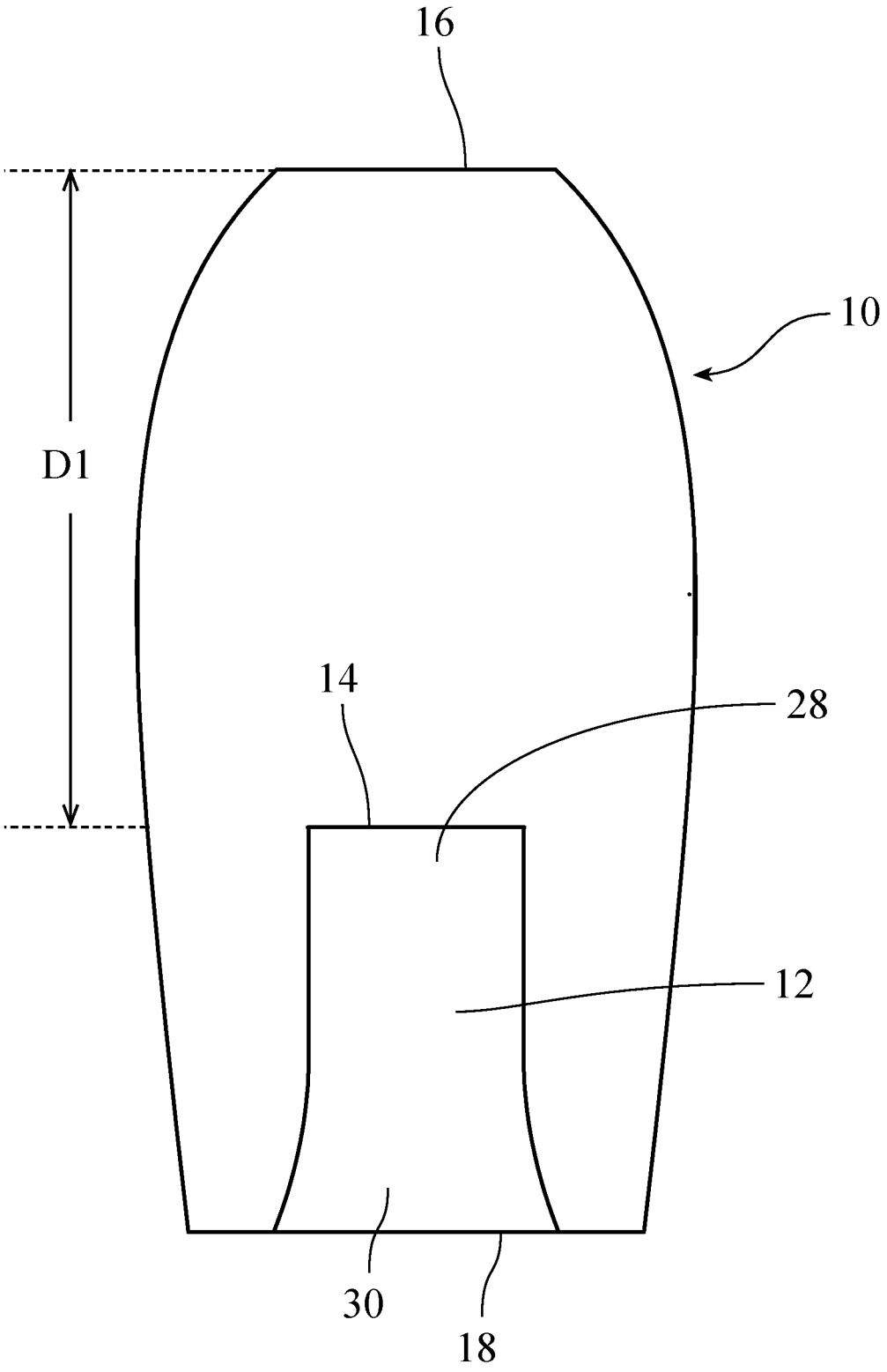
FIG. 1 is a bottom view of a surf craft having a channel formed on a bottom thereof according to one embodiment of the present disclosure.
Figure 5:
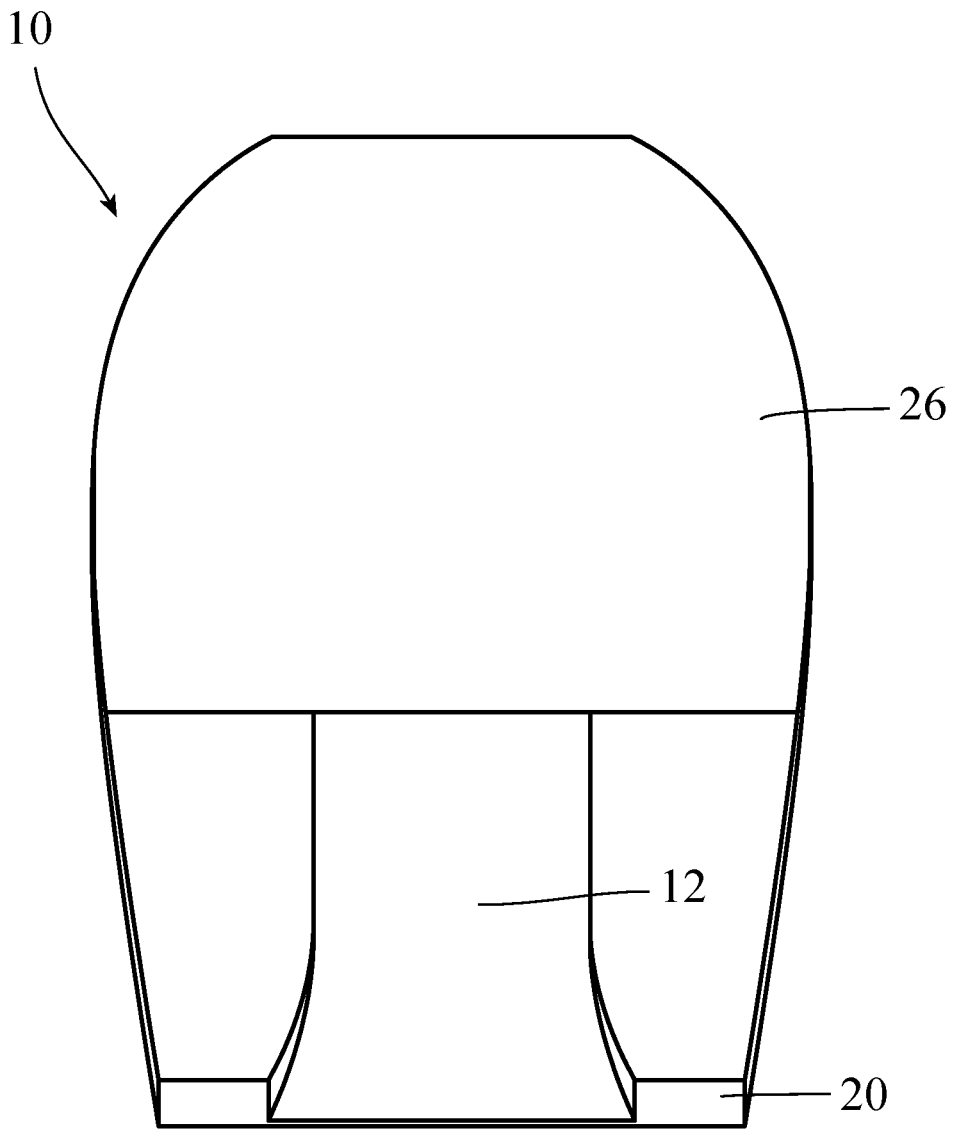
FIG. 5 shows a perspective rear view of a surf craft having a channel formed thereon according to one embodiment of the present disclosure.
Figure 6:
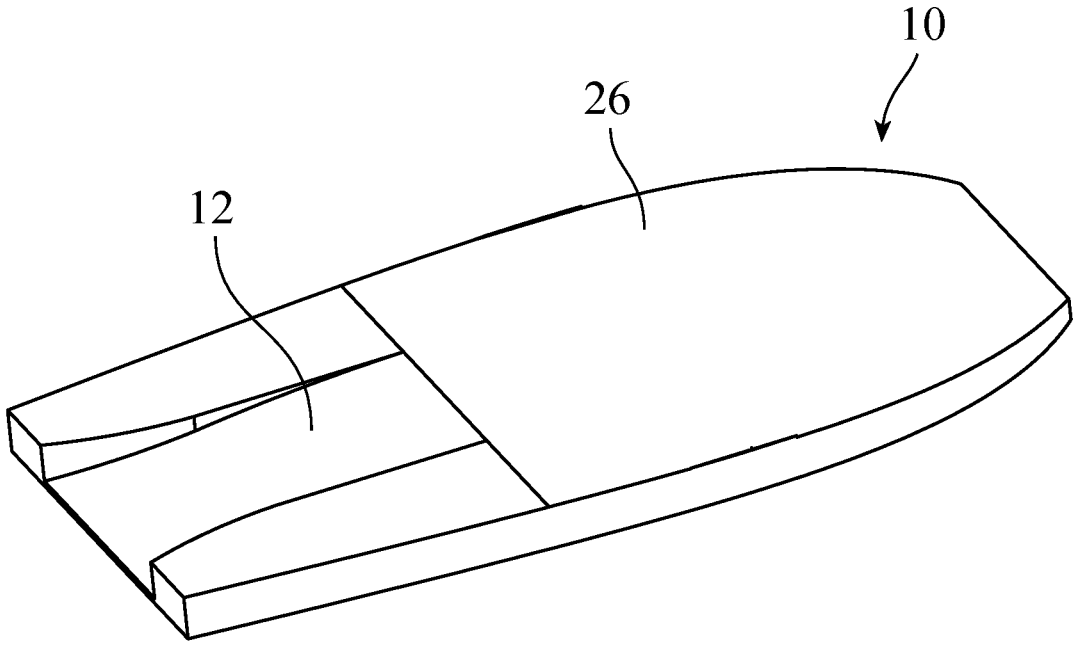
FIG. 6 shows a perspective side view of a surf craft having a channel formed thereon according to one embodiment of the present disclosure.

A surf craft 10 is provided including a channel 12 formed along a bottom surface of the surf craft 10. Referring to FIGS. 1 and 5, the channel 12 is shaped having a first end 14 that is located towards a nose 16 of the surf craft 10 and extends to a second end 18 that is proximate to a tail 20 (FIG. 5) of the surf craft 10. A width of the channel 12 varies along a length of the channel 12 such that the width is narrowest at the first end 14 of the channel 12 and widest at the second end 18 of the channel 12.

Figure 3:
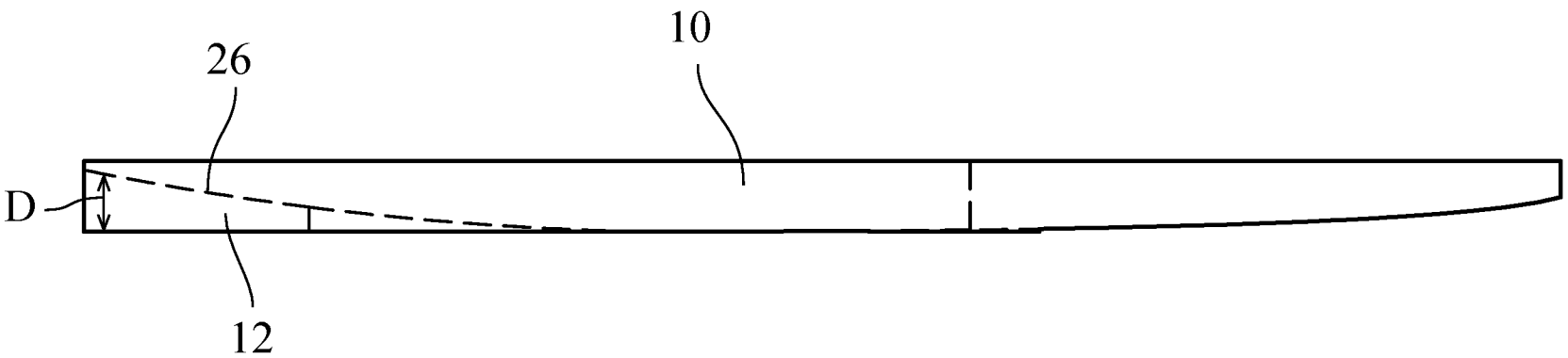
FIG. 3 shows a cross-sectional side view of a channel formed on a bottom of a surf craft according to one embodiment of the present disclosure.
Figure 4:
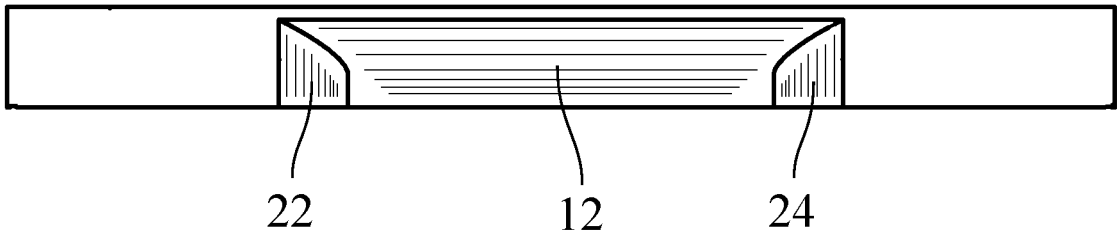
FIG. 4 shows an end view of a channel formed on a bottom of a surf craft according to one embodiment of the present disclosure.

As shown in FIG. 3, the channel 12 is shaped such that a depth of the channel 12 varies along a length of the channel 12. A depth D of the channel 12 preferably varies such that channel 12 is shallowest at the first end 14 of the channel 12 and deepest at the second end 18 of the channel 12. The channel 12 preferably is curved from the shallow first end 14 of the channel 12 to the deeper second end 18 of the channel 12. A depth across a width of the channel 12 extending from a first side wall 22 of the channel 12 to a second side wall 24 of the channel 12 is preferably constant, as shown in FIGS. 3 and 4.

The first side wall 22 and the second side wall 24 of the channel 12 are preferably substantially vertical and perpendicular to a bottom surface 26 of the channel 12 of the surf craft 10. At least a portion of the first side wall 22 and the second side wall 24 of the channel 12 may be substantially parallel to one another. The first side wall 22 and the second side wall 24 may intersect with the bottom surface 26 of the channel 12 at a substantially perpendicular angle. Alternatively, the first side wall 22 and the second side wall 24 may include a transition from surfaces of the first side wall 22 and the second side wall 24 to the bottom surface 26 of the channel 12. For example, intersections of the first side wall 22 and the second side wall 24 with the bottom surface 26 of the channel 12 may be curved such that a shape of the channel transitions between the first side wall 22, second side wall 24, and the bottom surface 26 of the channel.

Figure 2:
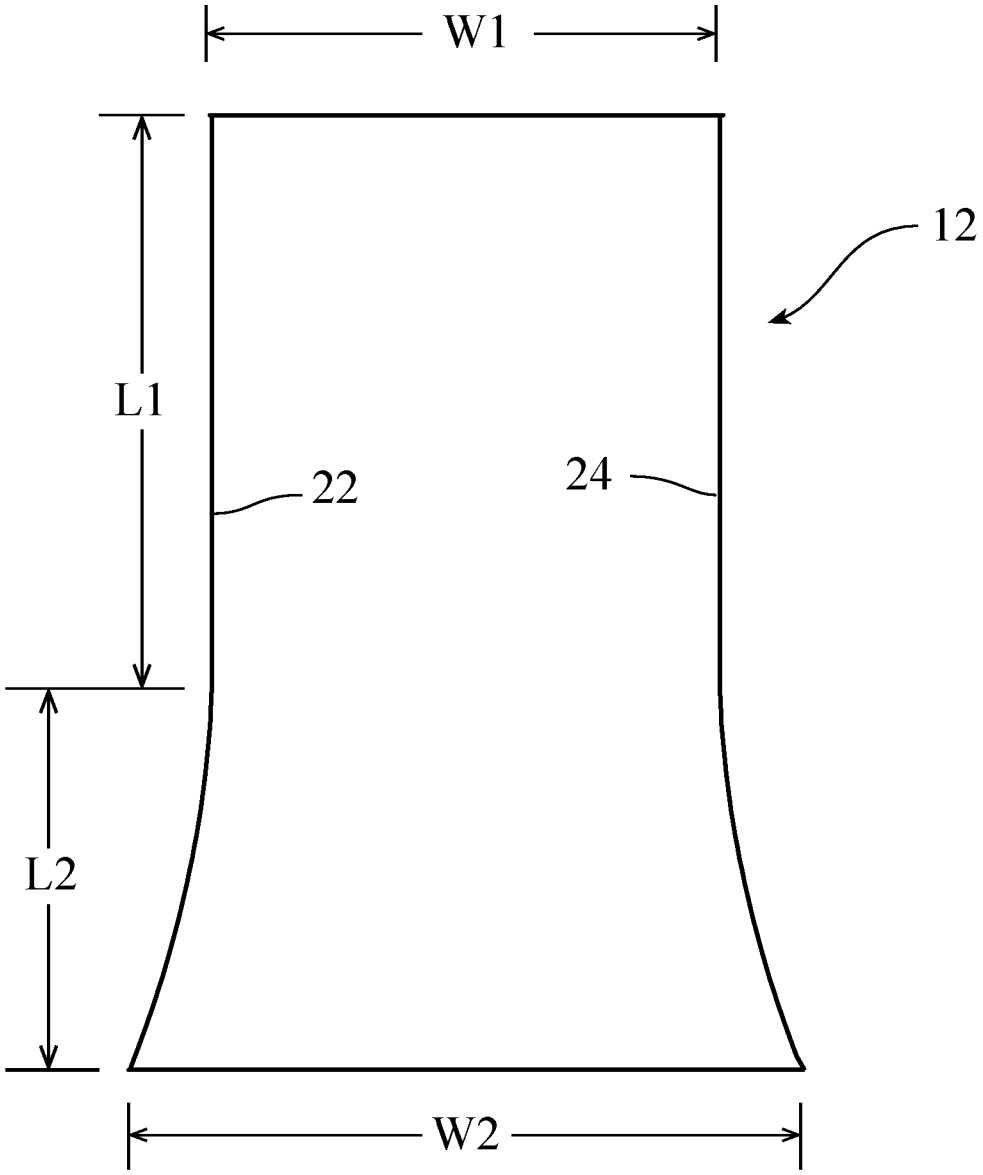
FIG. 2 shows a channel according to one embodiment of the present disclosure.

Referring to FIG. 2, the first side wall 22 and the second side wall 24 are preferably substantially parallel to each other along at least a partial length of the channel 12 beginning at the first end 14 of the channel 12. In one embodiment, the first side wall 22 and the second side wall 24 are substantially parallel such that the first side wall 22 and the second side wall 24 are substantially straight along length L1. The length L1 is preferably from about 20% to about 80% of a length of the channel 12 beginning at the first end 14 of the channel 12. The first side wall 22 and the second side wall 24 preferably flare outward and curve along length L2 of the channel 12 such that a width of the channel 12 expands along length L2. In one embodiment the first side wall 22 and the second side wall 24 may form opposing asymptotic curves from the first end 14 of the channel 12. The width of the channel 12 increases from width W1 located between the first end 14 and the second end 18 of the channel 12 to width W2 located at the second end 18 of the channel 12.

Figure 16:
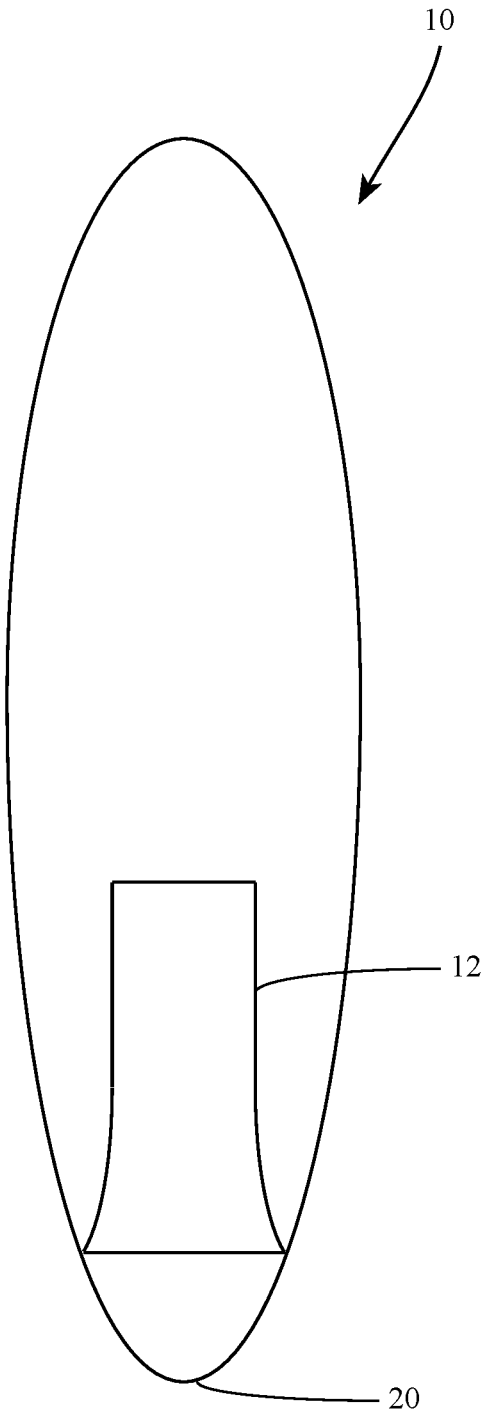
FIG. 16 shows a schematic view of a surf craft having a round or diamond-tail shape according to one embodiment of the present disclosure.
Figure 17:
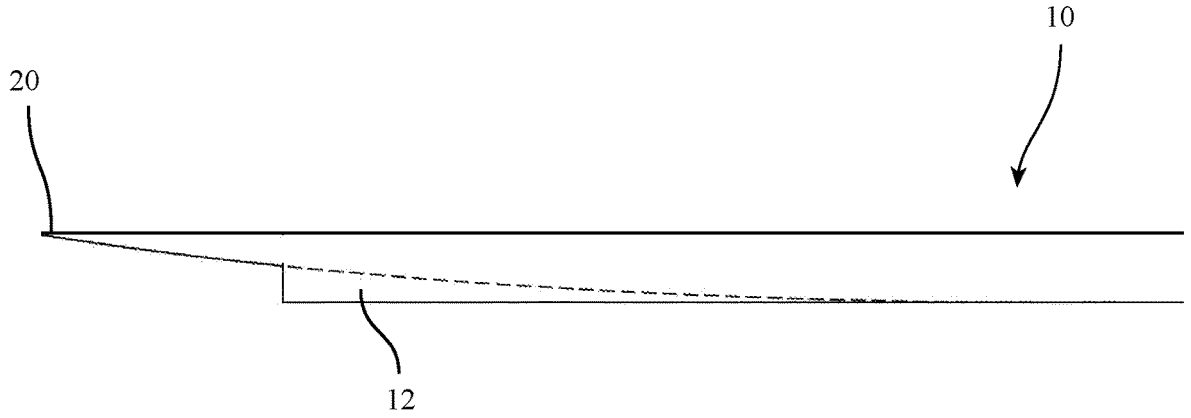
FIG. 17 shows a side view of a surf board having a round or diamond-tail shape according to one embodiment of the present disclosure.

An entrance 28 of the channel 12 is preferably located at a distance D1 (FIG. 1) from a nose of the surf craft 10 that is from about 40% to about 90% of a length of the surf craft 10. An outlet 30 of the channel 12 is preferably located proximate to the tail 20 of the surf craft 10. In one embodiment, the outlet 30 is located towards the tail 20 such that the outlet is located a distance from the tail 20 that is from about 0% to about 40% of the length of the surf craft 10. Although the figures illustrate the tail 20 of the surf craft 10 being substantially square, it is also understood that embodiments of the channel 12 may be formed on a surf craft 10 having other various shapes. For example, the channel 12 may be formed on surf craft 10 having round, pin, and diamond-tail shaped tails as shown in FIGS. 16 and 17. In the embodiment of FIGS. 16 and 17, the outlet 30 of the channel 12 may be located at least partially away from the tail 20 of the surf craft 10.

Referring again to FIG. 3, a depth of the channel 12 preferably varies from the first end 14 to the second end 18 of the channel 12. A depth of the channel 12 at the first end 14 is preferably 0% of a maximum thickness of the surf craft 10 such that the first end 14 of the channel 12 is substantially flush with a bottom of the surf craft 10. The second end 18 of the channel 12 preferably has a depth of from about 10% to about 100% of the maximum thickness of the surf craft 10.

In one specific and non-limiting example, a length of the surf craft 10 may be 42 inches and a width of the surf craft may be 22 inches. The surf craft 10 further may have a thickness of 2 inches. A total length of the channel 12 formed on the bottom thereof may be from about 14 inches to about 18 inches, and more preferably approximately 16 inches. The first side wall 22 and second side wall 24 are preferably parallel to one another along a first section of the channel for a length of from about 6 inches to about 12 inches, and more preferably about 9.6 inches, after which the first side wall 22 and second side wall 24 flare apart from one another. An entrance width of the channel 12 is preferably from about 7 inches to about 10 inches, and more preferably about 8.5 inches. An exit width of the channel 12 is preferably from about 10 inches to about 14 inches, and more preferably about 11.25 inches. The exit of the channel 12 is preferably located at the tail 20 of the surf craft 10. A depth of the channel 12 at the tail 20 of the surf craft 10 is at a maximum of 1.9 inches, and more preferably about 1.75 inches. The above dimensions are exemplary for one embodiment of a 42 inch long surf craft 10, and it is understood that dimensions may vary on similar length surf craft 10 and may further vary based on various dimensions of other surf craft 10.

Figure 7:
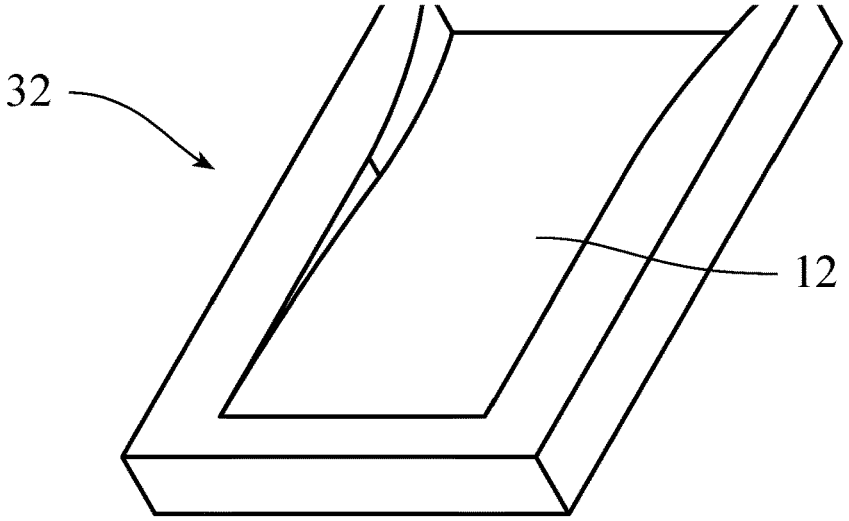
FIG. 7 shows a perspective view of a cartridge for a surf craft according to one embodiment of the present disclosure.
Figure 8:
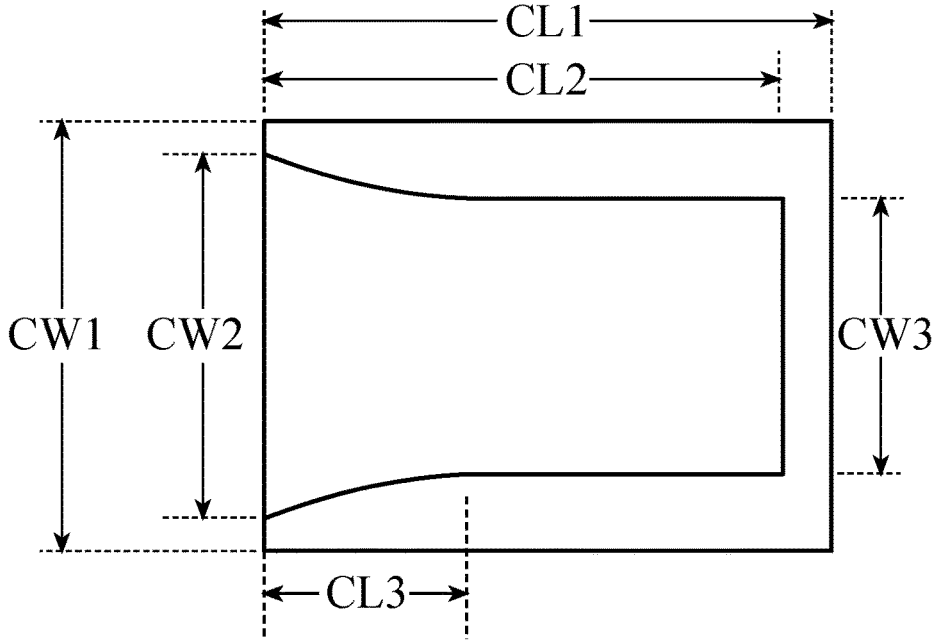
FIG. 8 shows a top view of a cartridge having a channel formed thereon according to one embodiment of the present disclosure.

Referring to FIGS. 7 and 8, in one embodiment, the surf craft 10 may be formed such that the channel 12 is formed on a cartridge 32. The cartridge 32 may be formed separately from the surf craft 10 and subsequently installed or otherwise mounted to the surf craft 10. The cartridge 32 may be formed such that the channel 12 has a shape that is desired for a particular version of the surf craft 10. For example, a plurality of cartridges 32 may be formed having the channel 12 with varying dimensions. A suitable cartridge may be selected for use with the surf craft 10 depending on desired characteristics of the surf craft 10. Although FIGS. 7 and 8 illustrate the cartridge having a rectangular shape, it is also understood that the cartridge may be formed in various other suitable shapes. For example, in one embodiment the cartridge may have a curved front portion to reduce a likelihood of the cartridge hinging relative to the surf craft 10 or otherwise breaking under stress.

Figure 9:
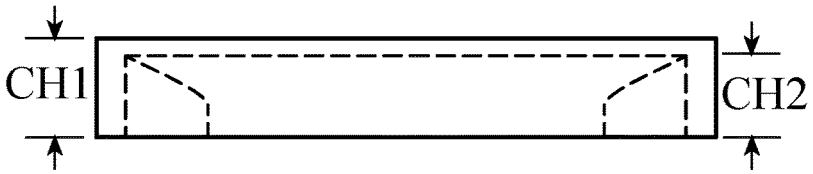
FIG. 9 shows an end view of a cartridge having a channel formed thereon according to one embodiment of the present disclosure.

In one specific and non-limiting example, the cartridge 32 includes the channel 12 formed thereon having dimensions that are suitable for use on the surf craft 10 and may vary depending on a size or shape of the surf craft 10. For example, the cartridge 32 may have an overall length CL1 of from about 24 inches to about 14 inches. The channel 12 formed on the cartridge 32 may have a length CL2 of from about 12 inches to about 22 inches. A length of a portion of the channel 12 wherein sidewalls of the channel 12 are curved CL3 may be from about 5 inches to about 10 inches. The cartridge 32 may have an overall width CW1 of from about 12 inches to about 16 inches. The channel 12 may have a width that varies from a widest width at CW2 of from about 9 inches to about 14 inches to a narrowest width at CW3 of from about 6 inches to about 11 inches. Referring to FIG. 9, in one exemplary embodiment the cartridge 32 has a total height CH1 of from about 2 inches to about 2.25 inches. The cartridge 32 may further have a channel depth CH2 at a deepest portion of the channel of from about 1.5" to about 2".

The channel may be shaped with one or more of CNC computer cutting, 3D printing or by hand as (3) three pieces that are glued together, (2) two sidewall sections and (1) one channel bottom section.

Figure 10:
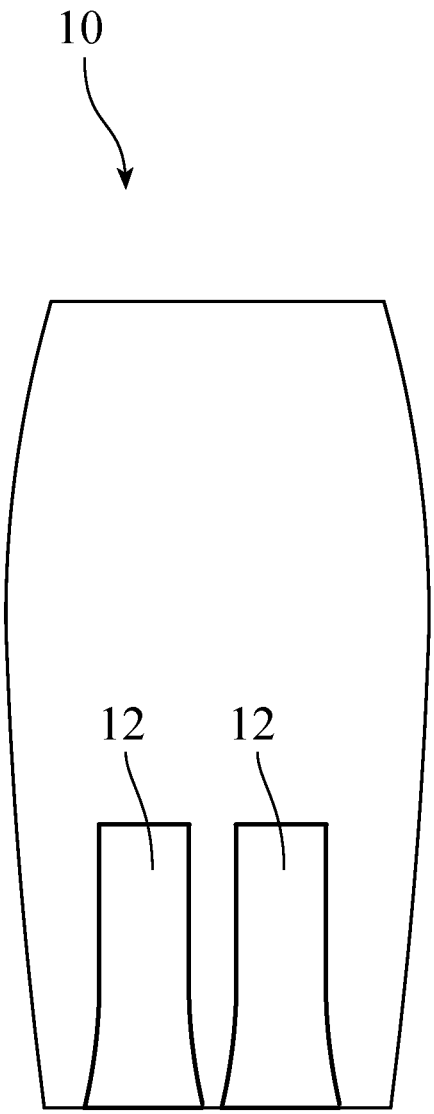
FIGS. 10 and 11 show a schematic view of a surf craft having at least two channels formed on a bottom thereof according to one embodiment of the present disclosure.
Figure 11:
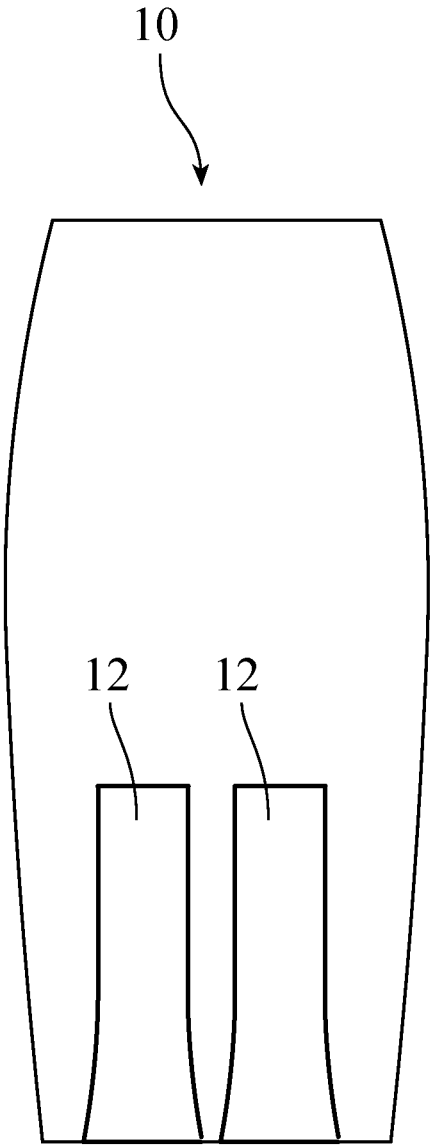
Figure 12:
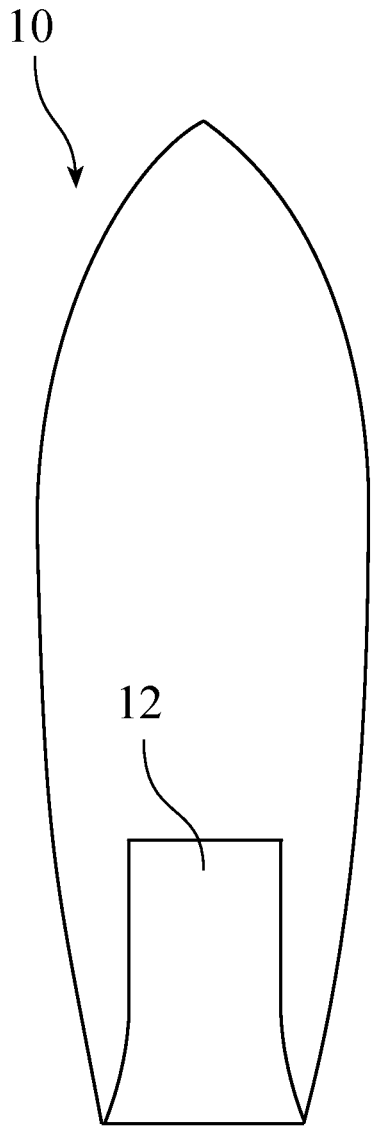
FIG. 12 shows a schematic view of a surfboard having a channel formed on a bottom thereof according to one embodiment of the present disclosure.
Figure 13:
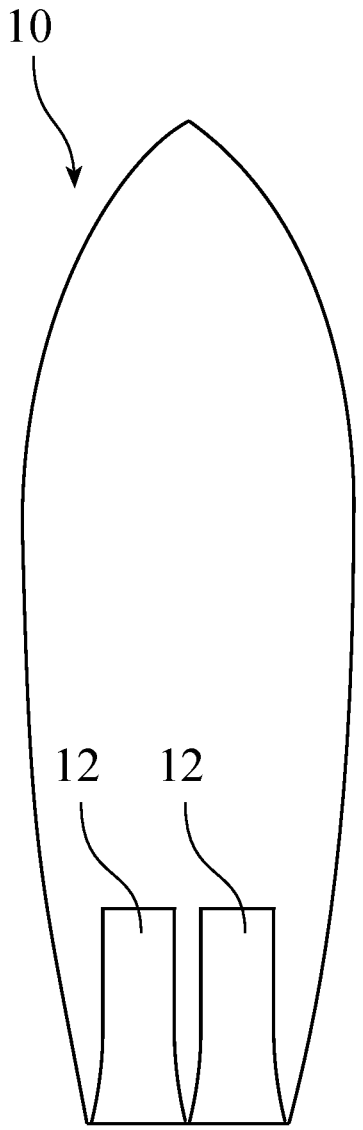
FIG. 13 shows a schematic view of a surfboard having a at least two channels formed on a bottom thereof according to one embodiment of the present disclosure.

Various configurations of the channel 12 on the bottom surface of the surf craft 10 may be suitable for enhancing the surf craft 10. For example, as shown in FIGS. 10 and 11, two or more channels 12 may be formed on the surf craft 10 such that the two or more channels 12 are substantially parallel. Embodiments described herein may further be suitable on various types of surf craft 10. For example, FIGS. 10 and 11 show a channel 12 formed on a bodyboard. FIGS. 12 and 13 illustrate a channel 12 formed according to embodiments herein on other types of surf craft, such as a surfboard.

Figure 14:
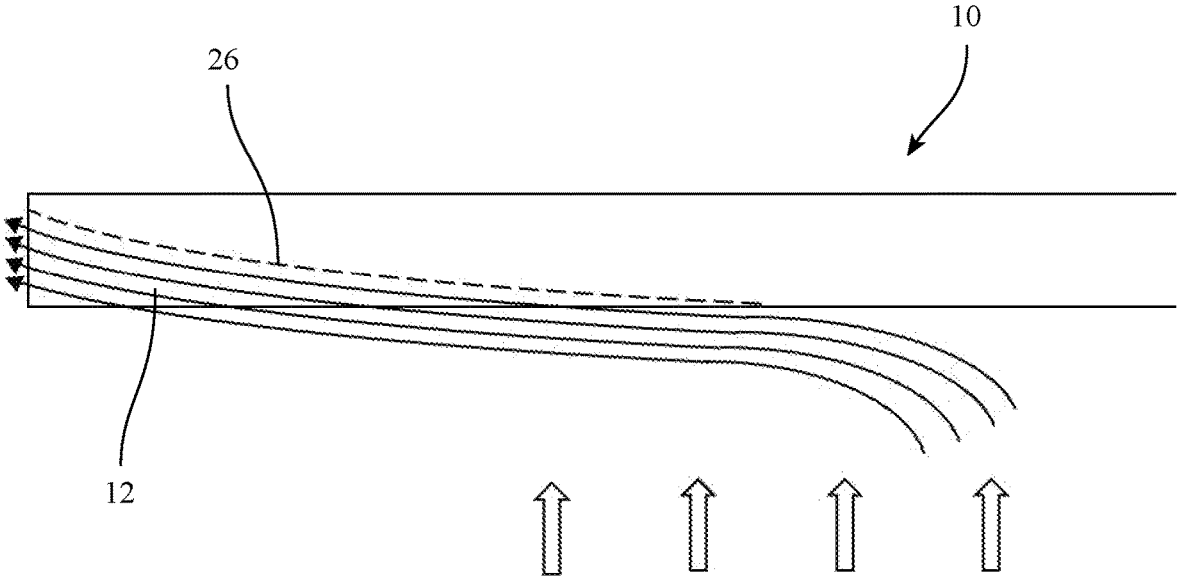
FIG. 14 is a cross-sectional side view schematically illustrating the Coanda Effect on a bottom surface of a channel of a surf craft according to one embodiment of the present disclosure.
Figure 15:
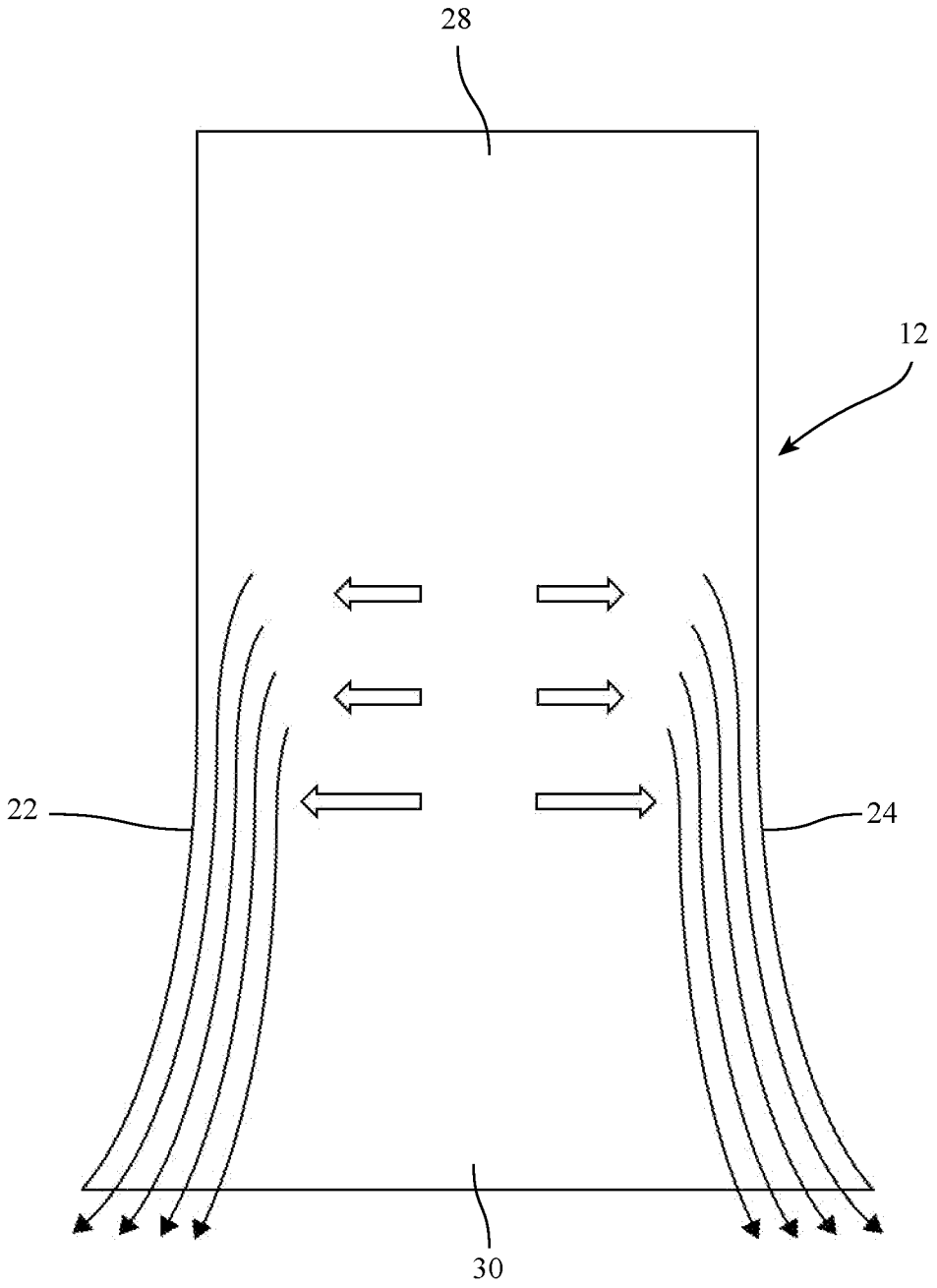
FIG. 15 is a bottom view schematically illustrating the Coanda Effect on sidewalls of a channel of a surf craft having a channel formed thereon according to one embodiment of the present disclosure.

Referring to FIGS. 14-15, the Coanda Effect is the tendency of a moving fluid stream to attach to and follow a curved surface, thereby creating a region of lower pressure. Water flowing over the bottom of the surf craft 10 is drawn into the channel 12 and flows along the channel 12 as the channel 12 increases in depth along its length. The vertical first side wall 22 and second side wall 24 further direct water along the first side wall 22 and second side wall 24 as the walls flare curving outwards, reducing pressure further within the channel 12. The first side wall 22 and second side wall 24 may be flared with a shape having parameters such that a maximum benefit of the Coanda Effect is produced on the channel 12 without causing significant loss of the Coanda Effect.

Embodiments of the surf craft 10 having the channel 12 formed thereon generate Coanda Effects along surfaces of the channel 12 in at least two dimensions. First, water flowing along the bottom of the surf craft 10 and into the channel flows along a longitudinal curve formed on the bottom surface 26 of the channel 12 as the channel 12 increases in depth along its length. Second, the flared first side wall 22 and second side wall 24 further enhance the Coanda Effect along the channel 12. Water flowing along the channel 12 clings to surfaces of the channel 12. The channel 12 lowers pressure along the bottom of the surf craft 10 beginning at the first end 14 of the channel 12. Low pressure generated along the channel 12 is further reduced along the length of the channel 12 as water flows towards the second end 18 of the channel 12. Curves of channel bottom 26, the first side wall 22 and second side wall 24 induce desired fluid dynamics properties along the channel 12 to induce the Coanda Effect along the channel. When low pressure is generated towards the tail of the surf craft 10, the tail of the surfcraft is held in place by the low pressure region at the tail of the surf craft 10. This enables control and stability of the surf craft 10, and further advantageously allows for control and stability with minimal effects on drag of the surf craft 10.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A surf craft comprising:

a body having a nose at a first end of the body and a tail at a second end of the body;

a substantially smooth bottom surface extending from the nose of the body to the tail of the body;

a channel formed in the substantially smooth bottom surface of the body, the channel including a channel entrance located towards the nose of the body of the surf craft, the channel entrance having a depth that is substantially flush with the substantially smooth bottom surface of the surf craft, a channel exit located towards the tail of the body, the channel exit having a depth such that a bottom surface of the channel curves from the substantially smooth bottom surface of the surf craft towards an upper surface of the surf craft, a first side wall and a second side wall, with a substantial portion of each of the first side wall and the second side wall oriented substantially perpendicular to the bottom surface of the channel of the surf craft, wherein the first side wall and the second side wall are substantially parallel to each other at the channel entrance and wherein the first side wall and the second side wall are opposed and curve outwards towards the channel exit such that a width of the channel exit is wider than a width of the channel entrance.

2. The surf craft of claim 1, wherein the first side wall and the second side wall are parallel to one another from the channel entrance to a distance that is from about 20% to about 80% of a length of the channel.

3. The surf craft of claim 1, wherein the first side wall and the second side wall are parallel from the channel entrance to a distance that is from about 40% to about 95% of a length of the channel.

4. The surf craft of claim 1, wherein the surf craft is a surfboard.

5. The surf craft of claim 1, wherein the surf craft is a body board.

6. The surf craft of claim 1, further comprising a second channel formed in the substantially smooth bottom surface of the body.

7. The surf craft of claim 1, wherein the channel is formed in a cartridge that is installed on the surf craft.

8. The surf craft of claim 1, wherein the first side wall and the second side wall are shaped as asymptotic curves.

9. The surf craft of claim 1, wherein the channel has a depth of from about 0 inches to about 0.1 inches at the entrance of the channel and a depth of from about 0.2 inches to about 4 inches at the channel exit.

10. The surf craft of claim 1, wherein the surf craft is selected from a group consisting of kneeboards, sailboards, wake surf boards, wakeboards, and paddle boards.

11. A surfboard comprising:

a body having a nose at a first end of the body and a tail at a second end of the body;

a substantially smooth bottom surface extending from the nose of the body to the tail of the body;

a channel formed in the substantially smooth bottom surface of the body, the channel including a channel entrance located towards the nose of the body of the surfboard, the channel entrance having a depth that is substantially flush with the substantially smooth bottom surface of the surfboard, a channel exit located towards the tail of the body, the channel exit having a depth such that a bottom surface of the channel curves from the substantially smooth bottom surface of the surfboard towards an upper surface of the surfboard, a first side wall and a second side wall opposed to the first side wall, with a substantial portion of each of the first side wall and the second side wall is oriented substantially perpendicular to the bottom surface of the channel of the surfboard, wherein the first side wall and the second side wall are substantially parallel to each other at the channel entrance and wherein the first side wall and the second side wall curve outwards towards the channel exit such that a width of the channel exit is wider than a width of the channel entrance.

12. The surf board of claim 11, further comprising a second channel formed in the substantially smooth bottom surface of the body.

13. A bodyboard comprising:

a body having a nose at a first end of the body and a tail at a second end of the body;

a substantially smooth bottom surface extending from the nose of the body to the tail of the body;

a channel formed in the substantially smooth bottom surface of the body, the channel including a channel entrance located towards the nose of the body of the bodyboard, the channel entrance having a depth that is substantially flush with the substantially smooth bottom surface of the bodyboard, a channel exit located towards the tail of the body, the channel exit having a depth such that a bottom surface of the channel curves from the substantially smooth bottom surface of the bodyboard surf craft towards an upper surface of the bodyboard, a first side wall and a second side wall opposed to the first side wall, with a substantial portion of each of the first side wall and the second side wall is oriented substantially perpendicular to the bottom surface of the channel of the bodyboard surf craft, wherein the first side wall and the second side wall are substantially parallel to each other at the channel entrance and wherein the first side wall and the second side wall opposed to the first side wall curve outwards towards the channel exit such that a width of the channel exit is wider than a width of the channel entrance.

14. The bodyboard of claim 13, further comprising a second channel formed in the substantially smooth bottom surface of the body.

* * * * *